US005175436A

United States Patent [19]

Puumalainen

[11] Patent Number: 5,175,436

[45] Date of Patent: Dec. 29, 1992

[54] METHOD OF PRODUCING HIGH-ENERGY ELECTRON CURTAINS WITH HIGH PERFORMANCE

[75] Inventor: Pertti Puumalainen, Savonlinna, Finland

[73] Assignee: Oy Tampella AB, Tampere, Finland

[21] Appl. No.: 720,426

[22] PCT Filed: Feb. 1, 1990

[86] PCT No.: PCT/FI90/00033

§ 371 Date: Jun. 27, 1991

§ 102(e) Date: Jun. 27, 1991

[87] PCT Pub. No.: WO90/09030

PCT Pub. Date: Aug. 9, 1990

[30] Foreign Application Priority Data

Feb. 2, 1989 [FI] Finland ..... 89-0494

[51] Int. Cl.[5] ..... H01J 33/00

[52] U.S. Cl. ..... 250/493.1; 250/492.3; 250/424; 313/420

[58] Field of Search ..... 250/424, 492.3, 493.1, 250/423 R; 313/420

[56] References Cited

U.S. PATENT DOCUMENTS

| | | | |
|---|---|---|---|
| 3,013,154 | 12/1961 | Trump | 250/492.3 |
| 3,144,552 | 8/1964 | Schonberg et al. | 250/492.3 |
| 3,469,139 | 9/1969 | Colvin | 313/420 |
| 3,702,412 | 11/1972 | Quintal | 313/299 |
| 4,048,534 | 9/1977 | Brewer et al. | 313/420 |
| 4,061,944 | 12/1977 | Gay | 313/420 |
| 4,362,965 | 12/1982 | Kendall | 313/420 |
| 4,543,487 | 9/1985 | Puumalainen et al. | 250/492.3 |

FOREIGN PATENT DOCUMENTS 2139414 11/1984 United Kingdom .

*Primary Examiner*—Jack I. Berman
*Attorney, Agent, or Firm*—Ladas & Parry

[57] ABSTRACT

The application of the electron beam technique in the polymerization of surfaces and purification of flue gases, for instance, often has a high demand of energy. The performance of prior art emitters, often considerably less than 50%, is thereby a major drawback. In the present method, low-energy shaping acceleration is applied first and thereafter the electrons are passed through windows very ideally and homogeneously by the proper acceleration. By means of the method, several successive and/or parallel windows can be provided in the device, the electron power being distributed evenly between said windows.

6 Claims, 1 Drawing Sheet

METHOD OF PRODUCING HIGH-ENERGY ELECTRON CURTAINS WITH HIGH PERFORMANCE

Figure 1:
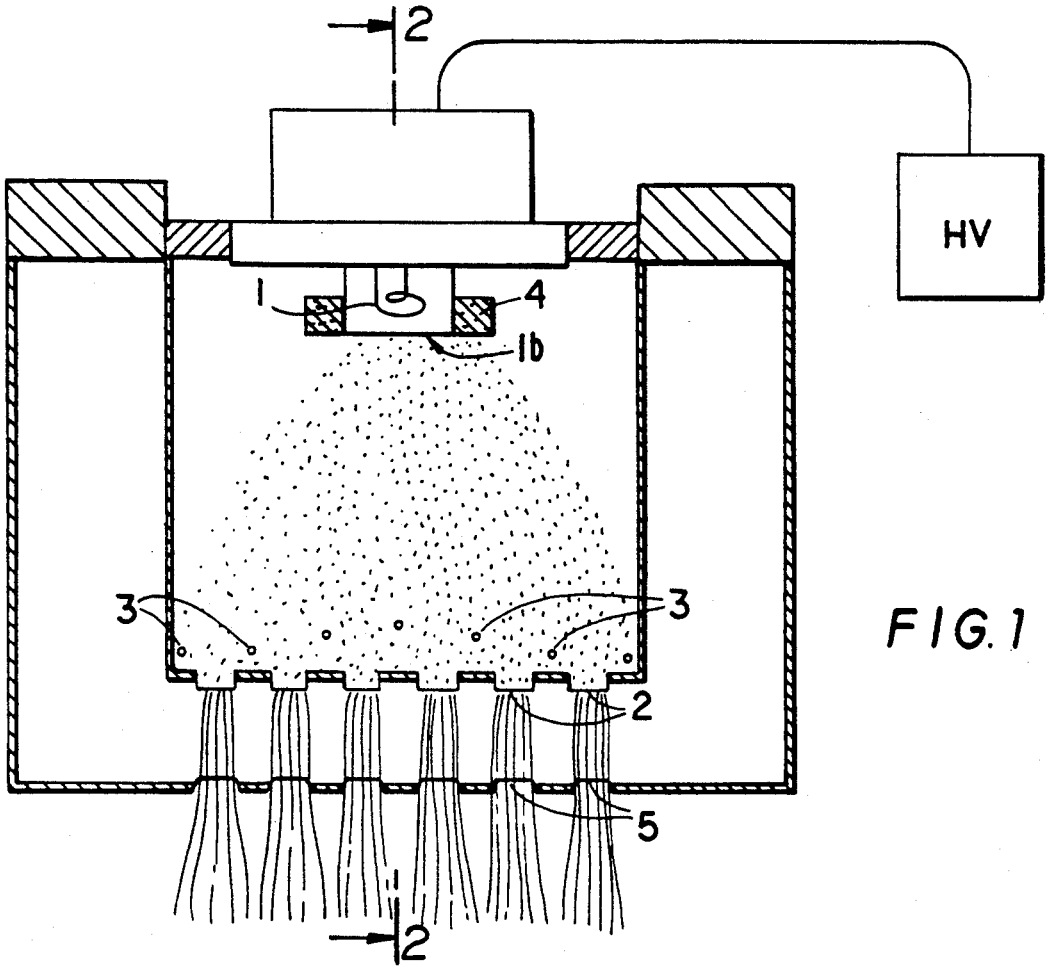

The invention relates to an electron accelerator technique for producing electrons having an energy of 100 keV to 800 keV for use in industrial processes.

Typical industrial applications include electronic polymerization of coatings and filling materials onto the surface of or within a material web and radiation sterilization of packing materials and products. Recently the electron beam technique has become increasingly popular in the purification of flue gases from sulphur and nitrogen oxides.

There are usually two types of devices: devices emitting electrons from one point and devices producing a curtain-like electron beam, for instance, across a material web passed evenly through the device in the transverse direction. The purpose of nearly all such industrial applications is to apply an even electron beam or radiation dose to the surface of a moving material web or to provide a radiation dose as constant as possible over the cross-sectional area of a flue gas flow. A high vacuum prevails inside electron accelerators, the electrons being introduced in the devices through long and narrow windows of metal foil transversely positioned relative to the mass flow.

At present, there are only a few manufacturers in the world that supply devices producing a curtainlike electron beam. In all these devices, the narrow window of metal foil is disposed so as to be protected from the lines of force caused by the accelerating voltage and supported by a cooling grid. Being positioned on the path of travel of the electrons, the grid causes a dissipation which is always at least equal to the ratio of the surface area of the cooling supports and that of the window. In prior art devices, this dissipation varies from about 25 to 35%. In addition, acceleration of electrons from one opening to another across an accelerating voltage always causes the electrons to strike the edges of the window opening and the surface of the cooling and supporting ribs protruding from the window openings as seen from the inside, the resultant dissipations being of the order of 10 to 25%. The window itself causes a dissipation of at least 5 to 15%. If the windows are replaced with a small hole formed in the device for the emission of electrons and for the discharge of the air forced inside the vacuum space by means of high-efficiency pumps systems, the emitted electron beam is first very dense and has to be allowed to get more even in the air before use as all electron beam applications require an even dose per volume or area unit. It can be readily calculated that the power required in a flue gas application, for instance, for achieving a minimum dose at each point of the cross-sectional profile is thereby three times greater than in devices producing a curtain-like beam. At present, it is necessary to use high efficiencies in the hidden emission means when accelerating from opening to opening, which often consumes 5 to 10% of the total efficiency. The estimated performance of this acceleration technique is generally as low as 20 to 40%. For instance, the energy consumed in the purification of flue gases by this technique in large power plants amounts to several per cents of the electric power demand of the plant, wherefore an improved performance is an important factor in making the purchase of these devices more attractive.

The object of the invention is achieved by means of a method which is mainly characterized by what is disclosed in the claims.

The major advantages of the present invention are obtained particularly by the electron acceleration technique, in which the shaping of the electron paths is carried out first in connection with the low-energy acceleration while the electrons are efficiently passed through the windows in the proper high-energy acceleration. The performance of each individual device is also increased because several successive windows can be provided in the device, each window emitting a high-energy electron curtain.

Figure 2:
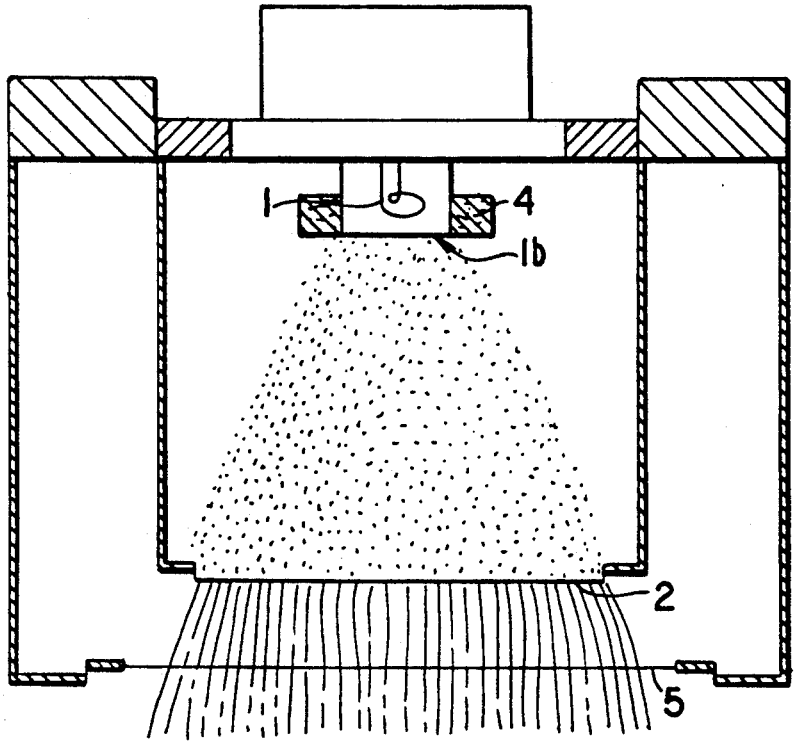

In the following the method of the invention will be described in greater detail with reference to the attached drawings, wherein FIG. 1 is a general view of a device of the invention in the direction of the long windows; and FIG. 2 is a sectional view of the device for applying the method along the line A—A shown in FIG. 1, the middlemost window being shown in the plane of the drawing.

In the method, electrons obtained from an electron source 1 are accelerated by a low-energy accelerating voltage towards grid-like preacceleration windows 2. The electron source comprises a primary emission means 1 and a plate-like secondary emission means 1*b* heated with electrons accelerated from the primary emission means. The electrons obtained from the surface of the secondary emission means are the electrons used in the accelerations. Counter voltage threads 3 disposed between the grid windows and a magnetic distributor 4 are provided to achieve an even passage of the electrons to the grid windows. The apparatus further comprises proper acceleration windows 5 disposed at a distance from the preacceleration windows 2. A voltage of 100 eV occurs between the electron source 1 and the preacceleration windows 2, so that the rate of travel of the electrons over this distance will not rise to any particularly high value. The counter voltage threads 3 are positioned at a different distance from the preacceleration windows 2, whereby the distance of the thread affects the distribution of the electrons in the sideward direction in such a way that the electron flow will be substantially even within the area of the preacceleration window. A voltage of about 300 kV occurs between the preacceleration windows 2 and the acceleration windows 5, whereby a strong acceleration effect is exerted on the electrons which have reached the preacceleration windows. Essential in the invention is that when a spot-like electron source is used a suitable area is selected from the electron flow and the electrons moving in this area are directed by means of the counter voltage threads 3 into the preacceleration windows 2 in the desired direction while superfluous electrons and electrons moving in an undesired direction are discarded when they hit the walls of the upper portion of the shaping chamber containing the electron source 1, because the attraction of the preacceleration windows 2 is weak in the upper portion of the shaping chamber. The voltage between the electron source 1 and the preacceleration windows 2 being only 100 eV, the dissipation caused by the discarded electrons is practically negligible as compared with the total power demand of the apparatus. Most of the power demand of the apparatus is consumed in the acceleration of the electrons which have hit the preacceleration windows, that is, the preselected electrons most of which will be contained in the final radiation, by means of the high accelerating voltage occurring between the preacceleration windows 2 and the proper acceleration windows 5. With an acceleration of 100 eV and a total acceleration of 300 keV, for instance, the shaping of the electron paths may consume even 90% of the electron power, which, however, is only 3 per mil of the total power. The electrons can also be drawn efficiently because the lines of force of the low accelerating voltage directly on the surface of the electron source are not sufficiently strong to bring about a breakdown caused by a plasma discharge. The proper high-voltage acceleration can now be effected directly between the downwardly recessed grid or preacceleration windows 2 and the upwardly curved acceleration windows 5, as shown in the figures, whereby the lines of force of the electric field always pass the electrons emitted from the grid windows evenly through the windows. In this way several (even tens of) windows are provided in place of one narrow window and the cooling grids of the windows are left out. The window material can consist of layers by providing, for instance a beryllium membrane efficiently transferring heat from the window to the cooled frame structure on the inner surface of a titanium window of high corrosion resistance. A window having this kind of double structure is also considerably more efficient than a conventional window consisting of titanium only. The corrosion resistance and mechanical strength of the titanium window can be further improved by nitrating its outer surface into a titanium nitride surface.

The invention is not restricted to the above applications but it can vary within the scope of the claims.

I claim:

1. A method of producing high-energy electron curtains by means of electron accelerators, wherein the electrons are first accelerated by a low voltage occurring between an electron source and preacceleration windows and then accelerated by a high voltage occurring between the preacceleration windows and acceleration windows, comprising an electron source having a plate-like secondary emission means which is heated with electrons accelerated from a primary emission means, the electrons obtained from the surface of the secondary emission means being used in the accelerations, and the electrons obtained from the secondary emission means and being accelerated by a low voltage being shaped both by electric counter voltages and magnetic distribution to form a homogeneous flow to the preacceleration windows, disregarding the loss of electrons to the walls and the edges of the windows.

2. A method according to claim 1, wherein the low-voltage preacceleration windows use downwardly recessed grid windows while the acceleration windows use upwardly curved windows, whereby the lines of force of the high accelerating voltage go homogeneously from one window to the other.

3. A method according to claim 1, wherein as each one of said windows is used a window comprising several layers one of which is a beryllium metal layer which transfers heat from the window into the frame structures efficiently, the outermost layer being of a material highly resistant to corrosion.

4. A method according to claim 3, wherein titanium is used as the material highly resistant to corrosion.

5. A method according to claim 3, wherein the acceleration window is treated chemically to improve its corrosion resistance.

6. A method according to claim 5, wherein the acceleration window made of titanium is provided with a titanium nitride surface.

* * * * *